US011573047B2

(12) United States Patent
Kumar et al.

(10) Patent No.: US 11,573,047 B2
(45) Date of Patent: Feb. 7, 2023

(54) REFRIGERATOR APPLIANCE

(71) Applicant: WHIRLPOOL CORPORATION, Benton Harbor, MI (US)

(72) Inventors: Amit Kumar, Pune (IN); Anil Ananda Kute, Pune (IN); Andrea Olivani, Milan (IT); Vishal Jaywantrao Patil, Pune (IN); Abhishek S. Awachat, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 149 days.

(21) Appl. No.: 17/217,383

(22) Filed: Mar. 30, 2021

(65) Prior Publication Data

US 2022/0316789 A1 Oct. 6, 2022

(51) Int. Cl.
*F25D 23/00* (2006.01)

(52) U.S. Cl.
CPC ..... *F25D 23/003* (2013.01); *F25D 23/006* (2013.01); *F25D 2323/0021* (2013.01); *F25D 2323/00264* (2013.01); *F25D 2323/00271* (2013.01)

(58) Field of Classification Search
CPC ..... F25D 23/003; F25D 2323/0021; F25D 2323/00266; F25D 2323/00262; F25D 2323/00268; F25D 2323/00265; F25D 23/006; F25D 2323/00264; F25D 2323/00271
See application file for complete search history.

(56) References Cited

U.S. PATENT DOCUMENTS

| | | | |
|---|---|---|---|
| 7,549,300 | B2 | 6/2009 | Chun et al. |
| 2005/0120738 | A1 | 6/2005 | Chun et al. |
| 2020/0348071 | A1 | 11/2020 | Yang et al. |

FOREIGN PATENT DOCUMENTS

| | | | | |
|---|---|---|---|---|
| CN | 107421220 | A | 12/2017 | |
| DE | 19933603 | * | 1/2001 | ..... F25D 23/003 |
| EP | 1526348 | A1 | 4/2005 | |
| GB | 2338287 | * | 12/1999 | ..... F25D 23/00 |
| IT | TO20130136 | A1 | 8/2014 | |
| KR | 100583199 | B1 | 5/2006 | |
| KR | 20100062019 | A | 6/2010 | |
| WO | 2020098082 | A1 | 5/2020 | |

OTHER PUBLICATIONS

Machine translated text of DE 19933603 (translated Nov. 2022) (Year: 1999).*

* cited by examiner

*Primary Examiner* — Cassey D Bauer
(74) *Attorney, Agent, or Firm* — Brooks Kushman P.C.

(57) ABSTRACT

A refrigerator appliance includes a rear wall, side walls, a bottom wall, and partitions. The side walls are secured to and extend from the rear wall toward a front side of the refrigerator. The bottom wall is secured to the side walls along a bottom end of the rear wall. The side walls and the bottom wall define a cavity below the bottom wall and define an opening to the cavity along the front side of the refrigerator. The rear wall and the bottom wall define a machine compartment. An exterior surface of the rear wall defines an inlet to and an outlet from the machine compartment. A first partition extends outward from the exterior surface and is disposed between the inlet and the outlet. A second partition extends from a bottom of the first partition. The partitions are configured to segregate airflows between the inlet and outlet.

20 Claims, 6 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a rear wall, first and second side walls, a bottom wall, a vertically extending partition wall, and a horizontally extending partition wall. The first and second side walls are secured to and extend from the rear wall. The bottom wall is secured to a bottom end of the rear wall and to the first and second side walls at positions above bottom ends of the first and second side walls such that the bottom wall and the first and second side walls define a cavity below the bottom wall, and such that the bottom wall and the first and second side walls define a front opening to the cavity on an opposing side of the cavity relative to the rear wall. The rear wall, first and second side walls, and the bottom wall collectively define a compartment above the bottom wall. The compartment houses a condenser. An exterior surface of the rear wall defines an air inlet vent to the compartment and an air outlet vent from the compartment. The vertically extending partition wall is secured the exterior surface and is disposed between the air inlet vent and the air outlet vent. The vertically extending partition wall is configured to segregate an airflow into the air inlet vent from an airflow out of the air outlet vent along the exterior surface. The horizontally extending partition wall extends from a bottom end of the vertically extending partition wall. The horizontally extending partition wall is configured to segregate at least a portion of an airflow within the cavity from the air outlet vent.

A refrigerator appliance includes a rear wall, first and second side walls, a bottom wall, a first partition, and a second partition. The rear wall forms a back side of the refrigerator. The first and second side walls are secured to and extend from the rear wall toward a front side of the refrigerator. The bottom wall is secured to the first and second side walls along a bottom end of the rear wall. The first and second side walls and the bottom wall define a cavity below the bottom wall and define an opening to the cavity along the front side of the refrigerator. The rear wall and the bottom wall define a machine compartment above the bottom wall. An exterior surface of the rear wall defines an inlet to and an outlet from the machine compartment. The first partition extends outward from the exterior surface and is disposed between the inlet and the outlet. The first partition is configured to segregate an airflow into the inlet from an airflow out of the outlet along the exterior surface. The second partition extends downward from the bottom wall within the cavity and extends from the first partition to the opening. The second partition is configured to segregate the airflow into the inlet from the airflow out of the outlet within the cavity.

An air separation system for a refrigerator includes a refrigerator housing, at least one door, a vertical partition, and a horizontal partition. The refrigerator housing has a rear wall, a first side wall, a second side wall, a top wall, and a bottom wall. The first and second side walls extend away from the rear wall. The top and bottom walls are secured to the first side wall, second side wall, and the rear wall to define an internal storage chamber. The housing defines a machine compartment behind a bottom end of the rear wall and above the bottom wall. The at least one door is disposed over the internal storage chamber. At least one of a compressor, a condenser, and an air circulation fan is disposed within the machine compartment. The vertical partition is configured vertically on an exterior surface of the rear wall. The vertical partition extends the length of the rear wall to create a barrier along the exterior surface between a hot air exhaust flow path extending away from the machine compartment and a cold air intake flow path extending to the machine compartment. The horizontal partition extends horizontally from a bottom of the vertical partition at the rear wall. The horizontal partition is configured to segregate the hot air exhaust flow path from the cold air intake flow path along the bottom surface of the bottom wall.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
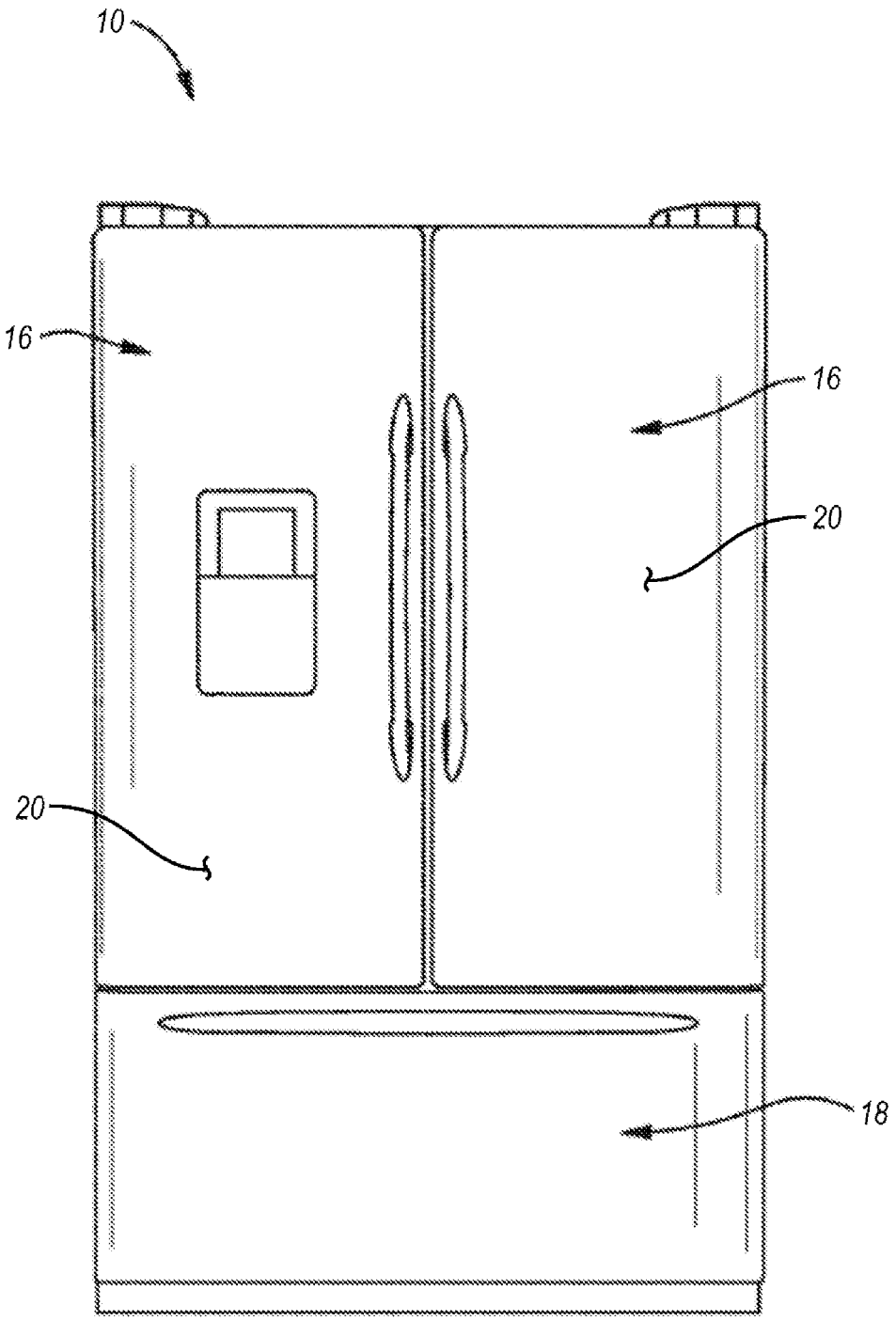
FIG. 1 is an elevated front view of a refrigerator appliance.
Figure 2:
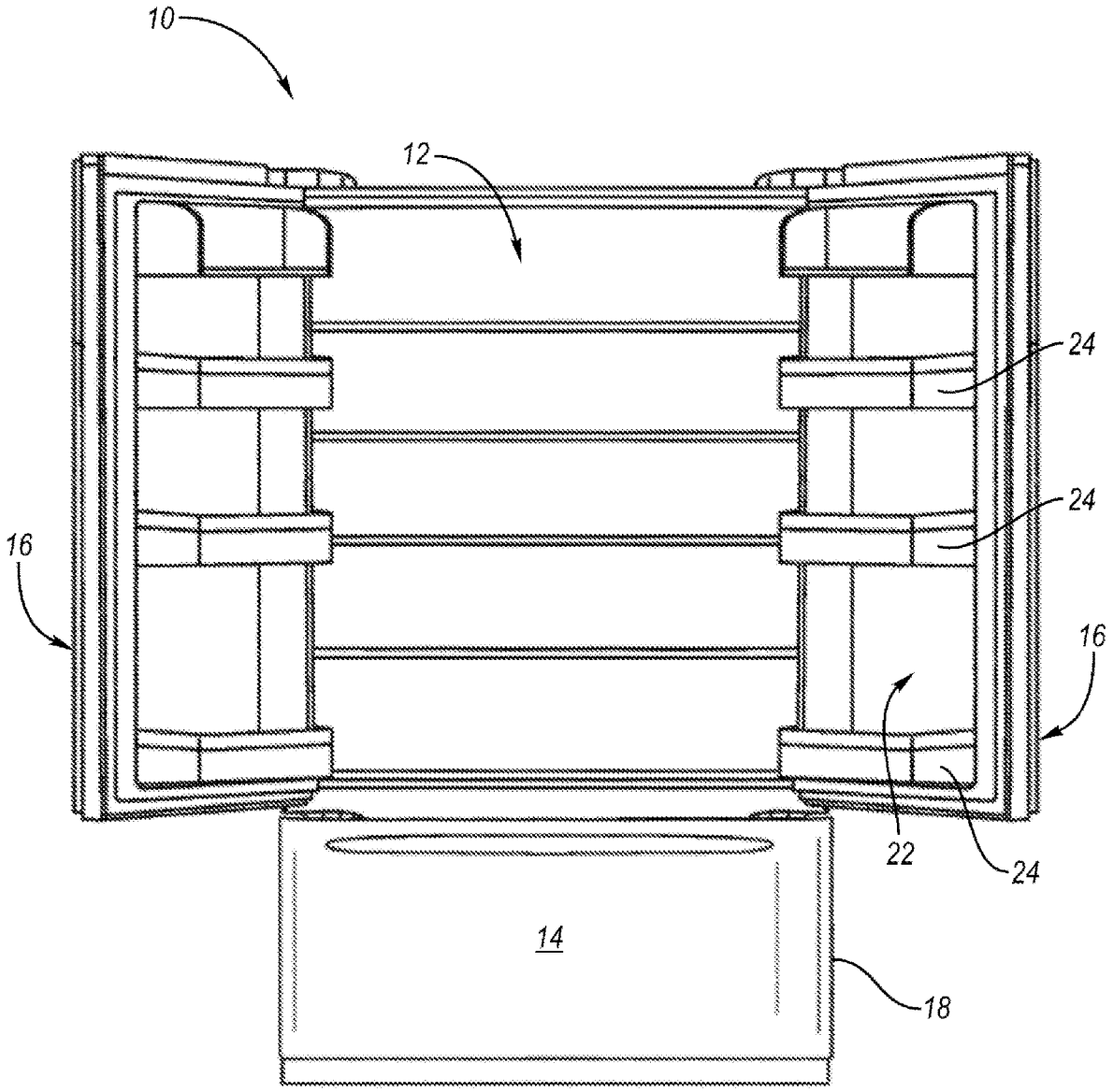
FIG. 2 is an elevated front view of the refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator appliance, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to a housing of the refrigerator 12 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold smaller food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves 26 (e.g., a lower surface upon, which a food item or container may rest upon) that extend from back surfaces 28 of the interior panels 22 of each door 16.

Figure 3:
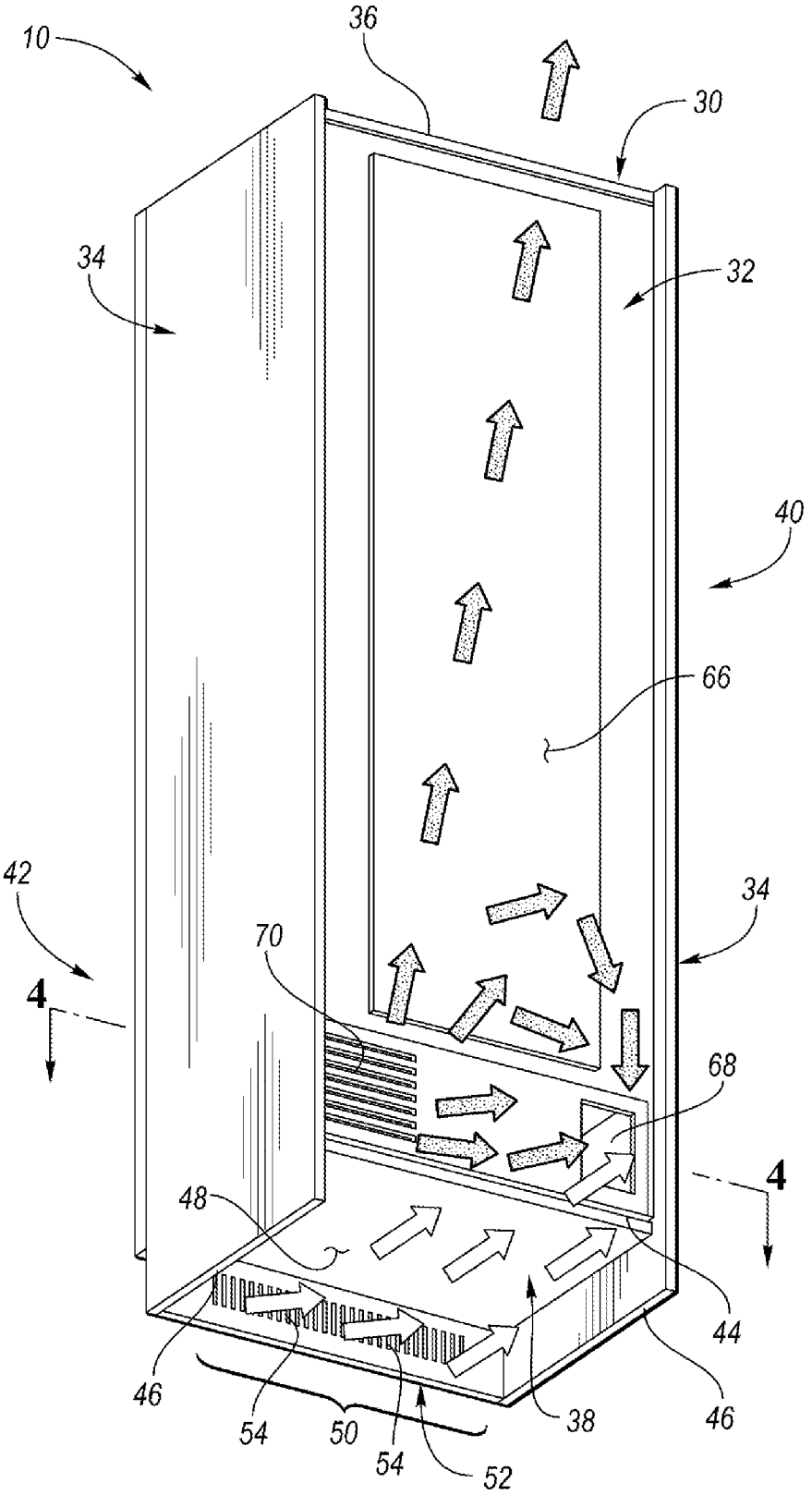
FIG. 3 is an isometric back view of the refrigerator appliance.
Figure 4:
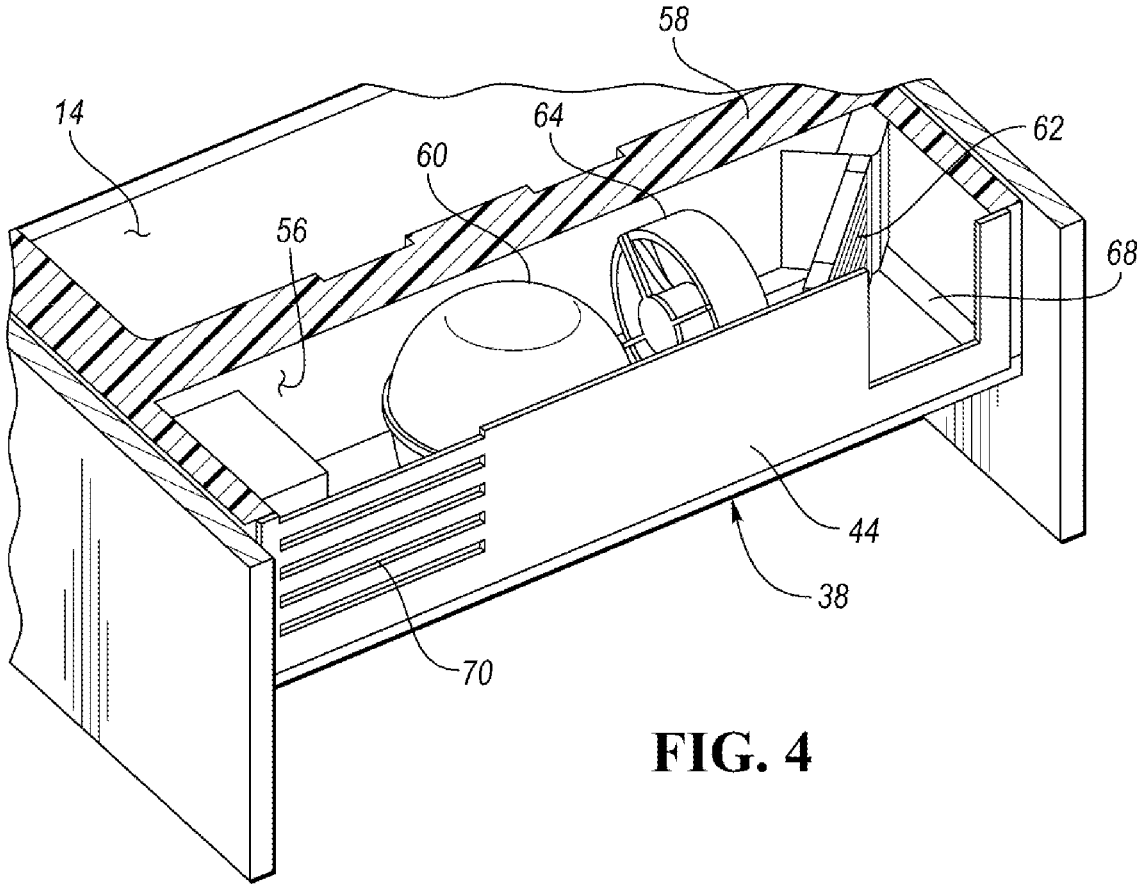
FIG. 4 is a cross-section view taken along line 4-4 in FIG. 3.

Referring to FIGS. 3 and 4, an isometric back view of the refrigerator 10 and a cross-sectional view taken along line 4-4 in FIG. 3 are illustrated, respectively. A housing 30 of the refrigerator includes a plurality of walls that define at least one internal chamber (e.g., fresh food compartment 12 and second internal storage chamber or a freezer compartment 14). The plurality of walls includes a rear wall 32, side walls 34, a top wall 36, and a bottom wall 38. The side walls 34 may also be referred to as first and second side walls. The rear wall 32 forms a back side 40 of the refrigerator 10. The side walls 34 are secured to and extend away from the rear wall 32. Stated in other terms the side walls 34 extend from the back side 40 of the refrigerator 10 to a front side 42 of the refrigerator 10. The top wall 36 and bottom wall 38 are each secured to the side walls 34 and the rear wall 32. The side walls 34, top wall 36, and bottom wall 38 define an opening to the at least one internal chamber on the front side 42 of the refrigerator 10. The doors 16 are secured to the housing 30 over the opening to the at least one chamber.

The bottom wall 38 is secured to a bottom end 44 of the rear wall 32. The bottom wall 38 is also secured the side walls 34 at positions above bottom ends 46 of the side walls 34 such that the bottom wall 38 and the side walls 34 define a cavity below 48 the bottom wall 38 and such that the bottom wall 38 and the side walls 34 define a front opening 50 to the cavity 48 on an opposing side of the cavity 48 relative to the rear wall 32 (i.e., on the front side 42 of the refrigerator 10). A cover 52 may be disposed over the front opening 50. The cover 52 may define at least one vent orifice 54. The rear wall 32, side walls 34, and the bottom wall 38 of the housing 30 define a compartment 56 above the bottom wall 32 and behind the bottom end 44 of the rear wall 32. The compartment 56 may also be referred to as the machine compartment and may be segregated from the at least one internal chamber (e.g., fresh food compartment 12 and second internal storage chamber or a freezer compartment 14) via insulating layer or internal lining 58 that insulates the at least one internal chamber. A compressor 60, a condenser 62, and an air circulation fan 64 may each be disposed within the compartment 56. An exterior surface 66 of the rear wall 32 defines an air inlet vent 68 to the compartment 56 and an air outlet vent 70 from the compartment 56. The air inlet vent 68 and an air outlet vent 70 are defined along the bottom end 44 of the rear wall 32 and adjacent to the bottom wall 38.

In order to properly cool the at least one internal chamber (e.g., fresh food compartment 12 and second internal storage chamber or a freezer compartment 14) of the refrigerator 10, heat needs to be rejected to the ambient surroundings. This is accomplished by drawing air into the compartment 56 through the air inlet vent 68, across the compressor 60 and condenser 62, and out of the air outlet vent 70. The circulation fan 64 provides the driving force to move the air through the compartment 56. The airflow into the compartment 56 via the air inlet vent 68 is illustrated by a first set of arrows that are not stippled. The airflow into the compartment 56 via the air inlet vent 68 may be referred to as the cold air intake flow path. The airflow out of the compartment 56 via the air outlet vent 70 is illustrated by a second set of arrows that are stippled. The airflow out the compartment 56 via the air outlet vent 70 may be referred to as the hot air exhaust flow path.

As show in FIG. 3, a portion of the hot air exhaust flow path may be directed into the air inlet vent 68 due to the proximity of the air inlet vent 68 to the air outlet vent 70. Directing the hot air from the exhaust flow path back into the compartment 56 will decrease the amount heat being rejected from the compressor 60 and condenser 62, which reduces the efficiency of the refrigeration process to maintain a desirable cool temperature with the at least one internal chamber (e.g., fresh food compartment 12 and second internal storage chamber or a freezer compartment 14). Therefore, it is desirable to prevent the air from the hot air exhaust flow path from be directed into to the air inlet vent 68.

Figure 5:
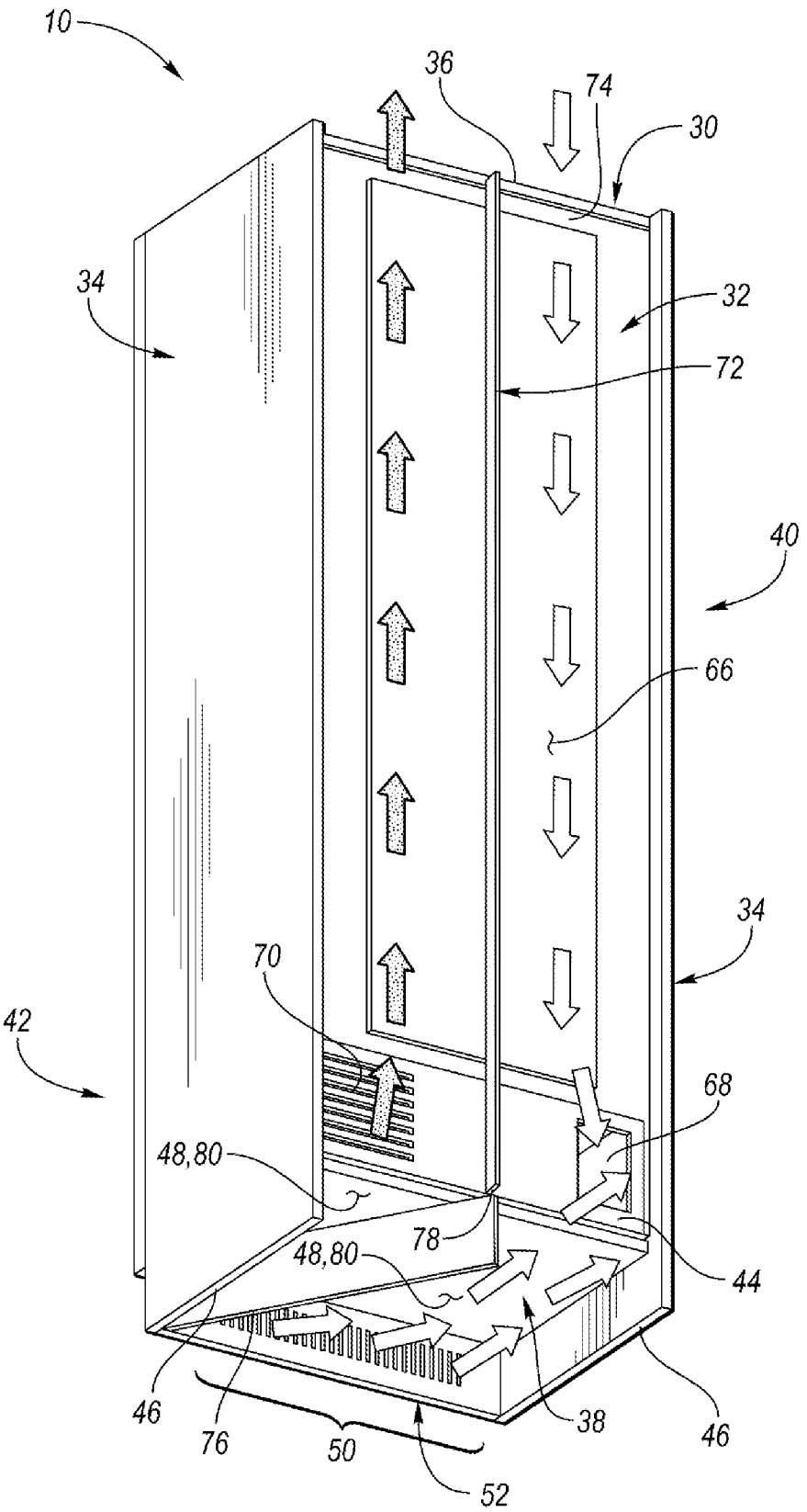
FIG. 5 is an isometric back view of the refrigerator appliance with a first air separation system installed thereon.

Referring to FIG. 5, an isometric back view of the refrigerator 10 with a first air separation system installed thereon is illustrated. It should be noted that all of the elements, characteristics, functions, etc. of the refrigerator 10 described with respect to FIGS. 3 and 4 should be construed to be included in FIG. 5 unless otherwise stated herein.

The first air separation system includes a first partition wall 72. The first partition wall 72 may be referred to as a vertically extending or vertical partition wall. The first partition wall 72 may extend outward from the exterior surface 66 of the rear wall 32 and may vertically extend the entire length of the rear wall from the bottom end 44 of the rear wall 32 to a top end 74 of the rear wall 32. More specifically, the first partition wall 72 may extend from the very top to the very bottom of the rear wall 32. The first partition wall 72 may also be centered between (i.e., at equal distances between) the side walls 34 along the vertical length the first partition 72. The first partition wall 72 is secured the exterior surface 66 of the rear wall 32. The first partition wall 72 is disposed between the air inlet vent 68 and the air outlet vent 70. The first partition wall 72 is configured to segregate the cold air intake flow path (i.e., the air flowing into the air inlet vent 68) from the hot air exhaust flow path (i.e., the air flowing out of the air outlet vent 70) along the exterior surface 66 of the rear wall 32. Stated in other terms, the first partition wall 72 creates a barrier along the exterior surface 66 of the rear wall 32 between the hot air exhaust flow path extending away from the compartment 56 via the air outlet vent 70 and the cold air intake flow path extending into the compartment 56 via the air inlet vent 68. It is noted that in FIG. 5, the cold air intake flow path is represented by a first set of arrows that are not stippled while the hot air exhaust flow path is represented by a second set of arrows that are stippled.

The first air separation system includes a second partition wall 76. The second partition wall 76 may be referred to as a horizontally extending or horizontal partition wall. The second partition wall 76 extends from a bottom end 78 of the first partition wall 72. The bottom end 78 of the first partition wall 72 is located at the bottom end 44 of the rear wall 32. The second partition wall 76 is configured to segregate the hot air exhaust flow path (i.e., the air flowing out of the air outlet vent 70) from the cold air intake flow path (i.e., the air flowing into the air inlet vent 68) along a bottom surface 80 of the bottom wall 38. The second partition wall 76 may also be configured to segregate at least a portion of an airflow within the cavity 48 that is defined below the bottom wall 38 from the air outlet vent 70.

The second partition wall 76 extends downward from the bottom wall 38 within the cavity 48 that is defined below the bottom wall 38. The second partition wall 76 extends from the first partition wall 72 to the front opening 50 within the cavity 48. The second partition wall 76 may also be positioned to segregate the front opening 50 from the air outlet vent 70. For example, the second partition wall 76 may extend at an angle from the bottom end 78 of the first partition wall 72 to an end of one of the side walls 34 at the front opening 50 (i.e., the intersection where the side wall 34 terminates and where the front opening 50 is defined) to segregate the front opening 50 from the air outlet vent 70.

Table 1 illustrates the increase in heat transfer, and therefore the efficiency of the refrigerator 10, when the first air separation system (e.g., the refrigerator illustrated in FIG. 5) is utilized relative to a baseline model (e.g., the refrigerator illustrated in FIG. 3). It is noted that in Table 1, the refrigerator 10 with the first air separation system is referred to as the New Model.

TABLE 1

| | Heat rejection of Condenser 62 (Watts) | Heat rejection of Compressor 60 (Watts) | Air Inlet Vent 68 Airflow rate (Cubic Feet/min) | Air Inlet Vent 68 Temp. (° C.) | Air Outlet Vent 70 Temp. (° C.) |
|---|---|---|---|---|---|
| Baseline Model | 63.29 | 39.3 | 37.63 | 36.6 | 41.0 |
| New Model | 110.54 | 46.87 | 43.4 | 32.5 | 39.2 |
| Difference Between New and Baseline Models | 47.3 (74.7%) | 7.6 (19.3%) | 5.8 (15.3%) | −4.1 | −1.8 |

Figure 6:
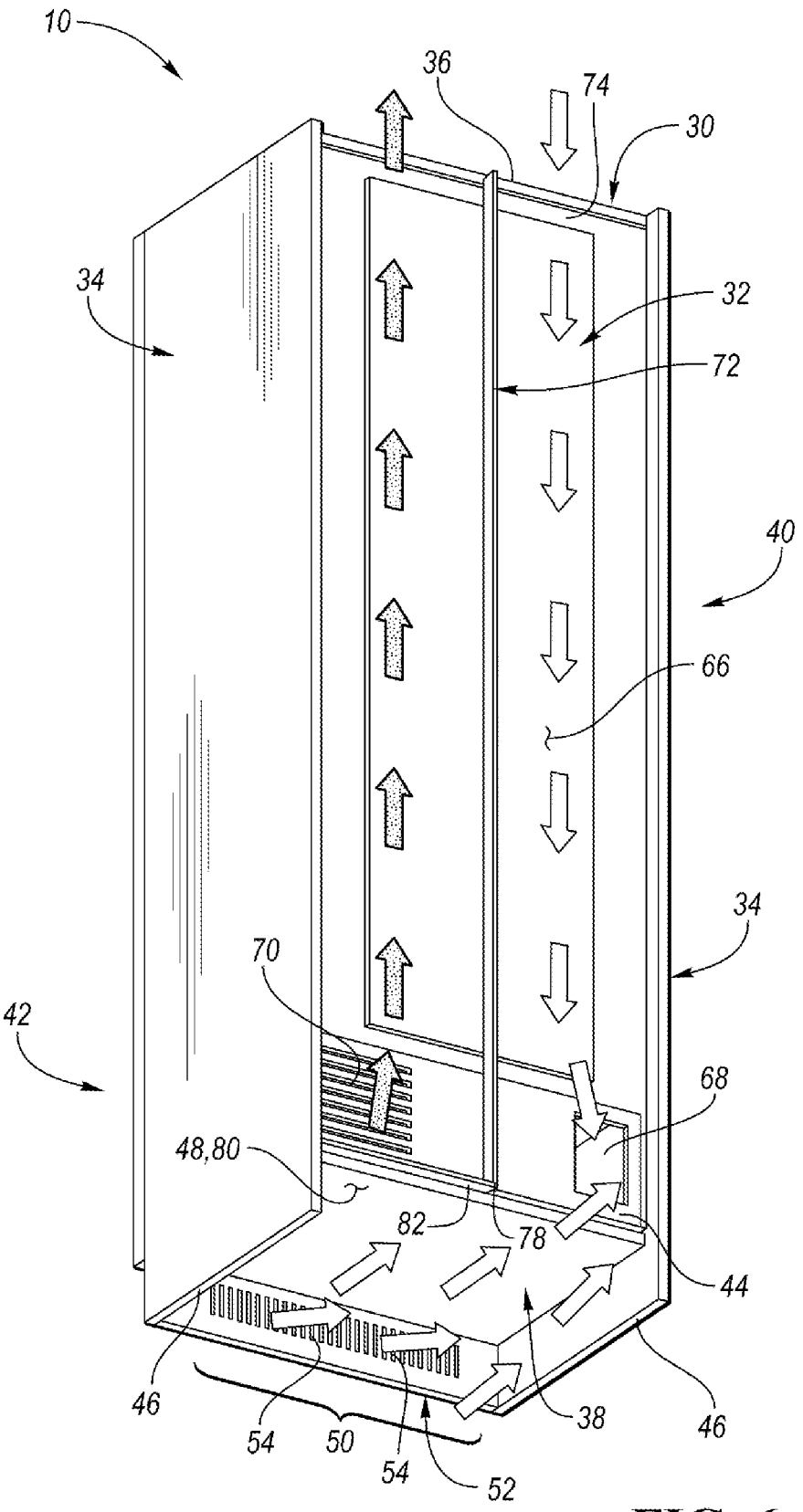
FIG. 6 is an isometric back view of the refrigerator appliance with a second air separation system installed thereon.

Referring to FIG. 6, an isometric back view of the refrigerator 10 with a second air separation system installed thereon is illustrated. It should be noted that all of the elements, characteristics, functions, etc. of the refrigerator 10 described with respect to FIGS. 3-5 should be construed to be included in FIG. 6 unless otherwise stated herein.

The second air separation system includes the first partition wall 72 as described with respect to FIG. 5. The second air separation system, however, includes a second partition wall 82 that is different than the second partition wall 76 described with respect to FIG. 5. The second partition wall 82 may also be referred to as a horizontally extending or horizontal partition wall. The second partition wall 82 extends from the bottom end 78 of the first partition wall 72 and along the bottom end 44 of the rear wall 32, below the air outlet vent 70, and to one of the side walls 34. The second partition wall 82 is configured to segregate the hot air exhaust flow path (i.e., the air flowing out of the air outlet vent 70) from the cold air intake flow path (i.e., the air flowing into the air inlet vent 68) along a bottom surface 80 of the bottom wall 38. More specifically, the second partition wall 82 may completely segregate the hot air exhaust flow path from the cavity 48 that is defined below the bottom wall 38. The second partition wall 82 may also be configured to segregate the airflow within the cavity 48 from the air outlet vent 70. Therefore, any airflow within the cavity may only contribute the cold air intake flow path. It is noted that in FIG. 6, the cold air intake flow path is represented by a first set of arrows that are not stippled while the hot air exhaust flow path is represented by a second set of arrows that are stippled.

Table 2 illustrates the increase in heat transfer, and therefore the efficiency of the refrigerator 10, when the second air separation system (e.g., the refrigerator illustrated in FIG. 6) is utilized relative to a baseline model (e.g., the refrigerator illustrated in FIG. 3). It is noted that in Table 2, the refrigerator 10 with the second air separation system is referred to as the New Model.

TABLE 2

| | Heat rejection of Condenser 62 (Watts) | Heat rejection of Compressor 60 (Watts) | Air Inlet Vent 68 Airflow rate (Cubic Feet/min) | Air Inlet Vent 68 Temp. (° C.) | Air Outlet Vent 70 Temp. (° C.) |
|---|---|---|---|---|---|
| Baseline Model | 63.29 | 39.3 | 37.63 | 36.6 | 41.0 |
| New Model | 113.71 | 47.28 | 43.8 | 32.35 | 39.1 |
| Difference Between New and Baseline Models | 50.4 (79.7%) | 8.0 (20.3%) | 6.2 (16.4%) | −4.3 | −1.9 |

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a rear wall;

first and second side walls secured to and extending from the rear wall;

a bottom wall secured to a bottom end of the rear wall and to the first and second side walls at positions above bottom ends of the first and second side walls such that the bottom wall and the first and second side walls define a cavity below the bottom wall and such that the bottom wall and the first and second side walls define a front opening to the cavity on an opposing side of the cavity relative to the rear wall, wherein the rear wall, first and second side walls, and the bottom wall collectively define a compartment above the bottom wall, wherein the compartment houses a condenser, and wherein an exterior surface of the rear wall defines an air inlet vent to the compartment and an air outlet vent from the compartment;

a vertically extending partition wall secured the exterior surface and disposed between the air inlet vent and the air outlet vent, wherein the vertically extending partition wall is configured to segregate an airflow into the air inlet vent from an airflow out of the air outlet vent along the exterior surface; and a horizontally extending partition wall extending from a bottom end of the vertically extending partition wall, wherein the horizontally extending partition wall is configured to segregate at least a portion of an airflow within the cavity from the air outlet vent.

2. The refrigerator appliance of claim 1, wherein the vertically extending partition wall extends from the bottom end to a top end of the rear wall.

3. The refrigerator appliance of claim 1, wherein the horizontally extending partition wall is disposed within the cavity and extends to the front opening.

4. The refrigerator appliance of claim 3, wherein the horizontally extending partition wall is configured to segregate the front opening from the air outlet vent.

5. The refrigerator appliance of claim 3, wherein the horizontally extending partition wall extends at an angle from the bottom end of the vertically extending partition wall to an end of one of the first and second side walls at the front opening.

6. The refrigerator appliance of claim 1, wherein the compartment further houses a fan and a compressor.

7. The refrigerator appliance of claim 1, wherein the horizontally extending partition wall extends from the bottom end of the vertically extending partition wall, along the bottom end of the rear wall, below the air outlet vent, and to one of the first or second side walls.

8. The refrigerator appliance of claim 1, wherein the air inlet vent and the air outlet vent are defined along the bottom end of the rear wall and adjacent to the bottom wall.

9. The refrigerator appliance of claim 1 further comprising a cover disposed over the front opening, wherein the cover defines at least one vent orifice.

10. A refrigerator appliance comprising:

a rear wall forming a back side of the refrigerator;

first and second side walls secured to and extending from the rear wall toward a front side of the refrigerator;

a bottom wall secured to the first and second side walls along a bottom end of the rear wall, wherein (i) the first and second side walls and the bottom wall define a cavity below the bottom wall and define an opening to the cavity along the front side of the refrigerator, (ii) the rear wall and the bottom wall define a machine compartment above the bottom wall, and (iii) an exterior surface of the rear wall defines an inlet to and an outlet from the machine compartment;

a first partition extending outward from the exterior surface and disposed between the inlet and the outlet, wherein the first partition is configured to segregate an airflow into the inlet from an airflow out of the outlet along the exterior surface; and a second partition extending downward from the bottom wall within the cavity and extending from the first partition to the opening, wherein the second partition is configured to segregate the airflow into the inlet from the airflow out of the outlet within the cavity.

11. The refrigerator appliance of claim 10, wherein the first partition extends from the bottom end to a top end of the rear wall.

12. The refrigerator appliance of claim 10, wherein the second partition is configured to segregate the opening from the outlet.

13. The refrigerator appliance of claim 10, wherein the second partition extends from a bottom end of the first partition to the opening.

14. The refrigerator appliance of claim 13, wherein the second partition extends at an angle from the bottom end of the first partition to an end of one of the first and second side walls at the opening.

15. The refrigerator appliance of claim 10, wherein the machine compartment houses at least one of a compressor, a condenser, and a fan.

16. The refrigerator appliance of claim 10, wherein the inlet and the outlet are defined along the bottom end of the rear wall and adjacent to the bottom wall.

17. An air separation system for a refrigerator, comprising:

a refrigerator housing having a rear wall, a first side wall, a second side wall, a top wall, and a bottom wall, wherein (i) the first and second side walls extend away from the rear wall, (ii) the top wall and bottom wall are secured to the first side wall, second side wall, and the rear wall to define an internal storage chamber, and (iii) the housing defines a machine compartment behind a bottom end of the rear wall and above the bottom wall;

at least one door disposed over the internal storage chamber along a front side of the refrigerator;

at least one of a compressor, a condenser, and an air circulation fan disposed within the machine compartment;

a vertical partition configured vertically on an exterior surface of the rear wall, the vertical partition extending the length of the rear wall to create a barrier along the exterior surface between a hot air exhaust flow path extending away from the machine compartment and a cold air intake flow path extending to the machine compartment; and a horizontal partition extending horizontally from bottoms of the vertical partition at the rear wall, wherein the horizontal partition is configured to segregate the hot air exhaust flow path from the cold air intake flow path along the bottom surface of the bottom wall.

18. The air separation system of claim 17, wherein the horizontal partition is configured on a bottom surface of the bottom wall and extends from the rear wall to the front side of the refrigerator.

19. The air separation system of claim 18, wherein the horizontal partition extends at an angle from the bottom of the vertical partition to an end of one of the first and second side walls.

20. The air separation system of claim 17, wherein the horizontal partition extends from the bottom of the vertical partition, along the bottom end of the rear wall, and to one of the first or second side walls.

* * * * *